United States Patent [19]

Clayton et al.

[11] Patent Number: 4,470,338

[45] Date of Patent: Sep. 11, 1984

[54] SELF OSCILLATING VACUUM ACTUATOR

[75] Inventors: Kenneth H. Clayton, Anderson; Melvin H. Hallmann, Middletown; Gerald O. Huntzinger; Burr E. Stephens, both of Anderson, all of Ind.

[73] Assignee: General Motors Corporation, Detroit, Mich.

[21] Appl. No.: 356,169

[22] Filed: Mar. 8, 1982

[51] Int. Cl.[3] ..... F01L 21/04; F15B 11/15

[52] U.S. Cl. ..... 91/342; 91/222; 91/229; 91/395; 137/624.14

[58] Field of Search ..... 91/342, 395, 222, 224, 91/229, 52, 341 R, 346, 394, 49, 50; 137/624.14; 310/339

[56] References Cited

U.S. PATENT DOCUMENTS

| | | | |
|---|---|---|---|
| 1,309,724 | 7/1919 | Folberth | 91/342 X |
| 2,642,845 | 6/1953 | Stevens | 91/395 |
| 2,884,905 | 5/1959 | Jensen | 91/52 X |
| 3,208,278 | 9/1965 | Herreman | 91/52 X |
| 3,500,753 | 3/1970 | Greene, Jr. | 91/50 X |
| 3,511,278 | 5/1970 | Good | 137/624.14 |
| 3,523,201 | 8/1970 | Good | 137/624.14 X |
| 3,523,202 | 8/1970 | Maire | 137/624.14 |
| 4,249,425 | 2/1981 | Watson | 474/110 |
| 4,298,342 | 11/1981 | Clayton et al. | 474/110 |
| 4,300,890 | 11/1981 | Hallman | 474/110 |

FOREIGN PATENT DOCUMENTS

| | | | |
|---|---|---|---|
| 390505 | 4/1933 | United Kingdom | 91/52 |

*Primary Examiner*—Irwin C. Cohen

*Attorney, Agent, or Firm*—C. K. Veenstra

[57] ABSTRACT

A vacuum actuator, suitable for use in an automatic belt tensioning system, oscillates automatically when connected to a source of constant vacuum.

1 Claim, 2 Drawing Figures

SELF OSCILLATING VACUUM ACTUATOR

TECHNICAL FIELD

This invention provides a self oscillating vacuum actuator suitable for use in an automatic belt tensioning system.

BACKGROUND

Many accessories driven by automotive engines are equipped with a drive belt which must be maintained at the correct tension, and a variety of devices have been proposed to automatically adjust the drive belt tension. U.S. Pat. Nos. 4,249,425, 4,298,342 and 4,300,890, for example, disclose systems which have a belt tensioning mechanism actuated by oscillations of a vacuum actuator. In those systems, the vacuum actuator oscillated in response to variations in vacuum produced by a gasoline engine induction system. Thus in the absence of special provisions, those systems have not been applicable to diesel engines because diesel engine induction systems do not produce a variable vacuum signal.

SUMMARY OF THE INVENTION

This invention provides a vacuum actuator which is suitable for use in the belt tensioning systems of the aforementioned patents and which makes those systems applicable to a diesel engine. The vacuum actuator provided by this invention may be operated by the constant vacuum signal produced by the engine driven vacuum pump often used in vehicles powered by diesel engines, and oscillates automatically in response to a constant vacuum signal. Such self-generated oscillations may be used to actuate the belt tensioning mechanism.

It will be appreciated, of course, that the self oscillating vacuum actuator provided by this invention is not limited to use in automatic belt tensioning systems and may find a wide variety of other applications.

In a vacuum actuator according to this invention, a diaphragm moves to a retracted position when vacuum is applied to the actuator. When the diaphragm reaches the retracted position, a valve assembly obstructs application of vacuum and admits air to the actuator. A return spring then moves the diaphragm to an advanced position. When the diaphragm reaches the advanced position, the valve assembly obstructs admission of air and again applies vacuum to the actuator. The diaphragm thus oscillates automatically between retracted and advanced positions when the actuator is connected to a source of vacuum.

The details as well as other features and advantages of this invention are set forth in the remainder of the specification and are shown in the accompanying drawing.

THE PREFERRED EMBODIMENTS

Figure 1:
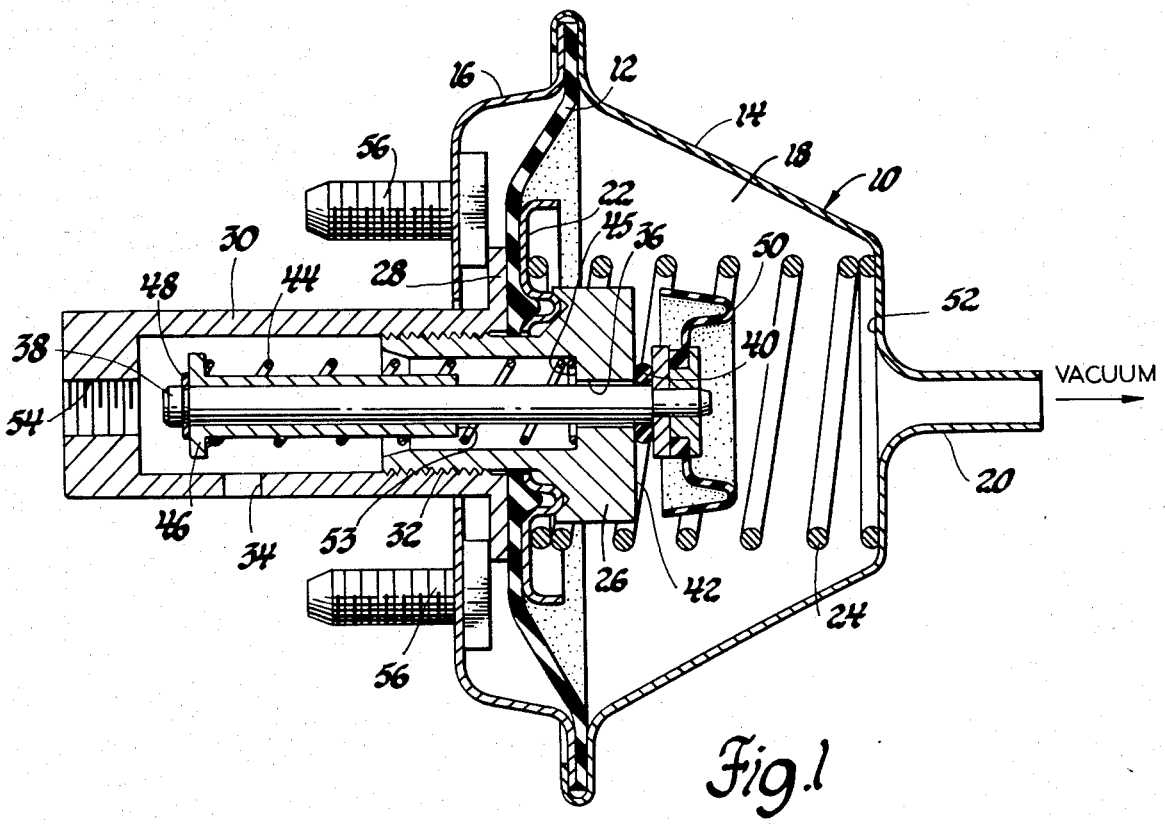
FIG. 1 is a sectional view of one embodiment of the self oscillating vacuum actuator provided by this invention.

Referring first to FIG. 1, a vacuum actuator 10 has a diaphragm 12 clamped between a housing 14 and a cover 16. A chamber 18 is defined between diaphragm 12 and housing 14, and housing 14 has an inlet fitting 20 adapted for connection to a source of vacuum for applying vacuum to chamber 18.

A backing plate 22 stiffens a central portion of diaphragm 12 and receives a spring 24 which biases diaphragm 12 to the advanced position shown. Diaphragm 12 and backing plate 22 are sandwiched between an orifice member 26 and the flange 28 of a link 30, link 30 being threaded onto orifice member 26 at 32. The interior of link 30 is exposed to the atmosphere, as suggested by the aperture indicated at 34, and orifice member 26 has a central orifice 36 for admitting air from the interior of link 30 into chamber 18.

A valve stem 38 is carried in orifice 36 and carries an O-ring valve member 40 adapted to engage the front surface 42 of orifice member 26 for obstructing air flow through orifice 36 into chamber 18. A pilot spring 44 is seated on the back 45 of orifice member 26 and acts through a sleeve 46 and a retaining ring 48 to bias valve stem 38 leftwardly so that O-ring valve member 40 engages surface 42.

Accordingly, when fitting 20 is connected to a source of vacuum, diaphragm 12 is retracted against the bias of spring 24, and a flexible valve seal 50 carried on valve stem 38 engages the surface 52 of housing 14. When valve seal 50 engages housing 14, application of vacuum to chamber 18 through fitting 20 is obstructed and diaphragm 12 is in its fully retracted position. However, seal 50 is compressible, and valve stem 38 moves rightwardly an additional amount against the bias of pilot spring 44 as the application of vacuum in inlet fitting 20 to seal 50 compresses seal 50. Such additional movement of valve stem 38 disengages O-ring valve member 40 from orifice member 26, and air enters chamber 18 through orifice 36. Spring 24 then moves diaphragm 12 to the advanced position illustrated. As diaphragm 12 carries orifice member 26 to the advanced position, pilot spring 44 is compressed until the back 45 of orifice member 26 engages a shoulder 53 on sleeve 46 to push sleeve 46 and valve stem 38 leftwardly and thus to disengage valve seal 50 from housing 14; the pressure across flexible seal 50 is thereby equalized, and pilot spring 44 thereupon reengages O-ring valve member 40 with orifice member 26. Air flow through orifice 36 into chamber 18 is then obstructed, and vacuum is again applied to chamber 18 through fitting 20.

Diaphragm 12 accordingly oscillates automatically between the retracted and advanced positions with its stroke—or the distance between the retracted and advanced positions—determined by the distance between shoulder 53 and the back 45 of orifice member 26. A connector suitably secured in the opening 54 of link 30 thus oscillates automatically with link 30 between advanced and retracted positions and may operate the automatic belt tensioning mechanism described in the aforementioned patents. Studs 56 projecting from cover 16 mount actuator 10 in the desired position.

Figure 2:
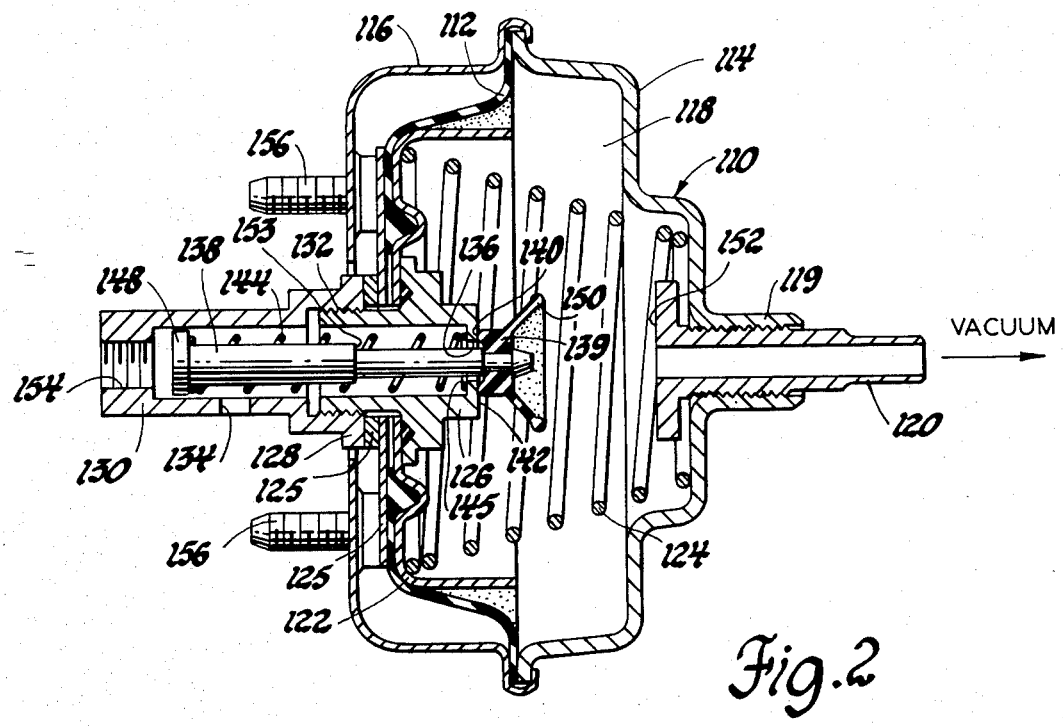
FIG. 2 is a sectional view of another embodiment of the self oscillating vacuum actuator provided by this invention.

Referring now to FIG. 2, a vacuum actuator 110 has a diaphragm 112 clamped between a housing 114 and a cover 116. A chamber 118 is defined between diaphragm 112 and housing 114, and housing 114 has a tubular portion 119 supporting a threaded inlet fitting 120 adapted for connection to a source of vacuum for applying vacuum to chamber 118.

A backing plate 122 stiffens a central portion of diaphragm 112 and receives a spring 124 which biases diaphragm 112 to the advanced position shown. Diaphragm 112, backing plate 122, and a pair of washers 125 are sandwiched between an orifice member 126 and the flange 128 of a link 130, link 130 being threaded onto orifice member 126 at 132. The interior of link 130 is exposed to the atmosphere, as suggested by the aperture indicated at 134, and orifice member 126 has a central orifice 136 for admitting air from the interior of link 130 into chamber 118.

A valve stem 138 is carried in orifice 136 and carries a valve member 139 having a valve bead 140 adapted to engage the front surface 142 of orifice member 126 for obstructing air flow through orifice 136 into chamber 118. A pilot spring 144 is seated on the back 145 of orifice member 126 and acts through a flange 148 on valve stem 138 to bias valve stem 138 leftwardly so that valve bead 140 engages surface 142.

Accordingly, when fitting 120 is connected to a source of vacuum, diaphragm 112 is retracted against the bias of spring 124 until a projecting flexible valve seal 150 on valve member 139 engages the surface 152 of fitting 120. When seal 150 engages fitting 120, application of vacuum to chamber 118 through fitting 120 is obstructed and diaphragm 112 is in its fully retracted position. However, seal 150 is compressible, and valve stem 138 may move rightwardly an additional amount against the bias of pilot spring 144 as the application of vacuum in inlet fitting 120 to seal 150 compresses seal 150. Such additional movement of valve stem 138 disengages valve bead 140 from orifice member 126, and air enters chamber 118 through orifice 136, spring 124 then moves diaphragm 112 to the advanced position illustrated. As diaphragm 112 carries orifice member 126 to the advanced position, pilot spring 144 is compressed until the back 145 of orifice member 126 engages a shoulder 153 on valve stem 138 to push valve stem 138 leftwardly and thus to disengage seal 150 from fitting 120; the pressure across flexible seal 150 is thereby equalized, and pilot spring 144 thereupon reengages valve bead 140 with orifice member 126. Air flow through orifice 136 into chamber 118 is then obstructed, and vacuum is again applied to chamber 118 through fitting 120.

Diaphragm 112 accordingly oscillates automatically between the retracted and advanced positions with its stroke determined by the distance between shoulder 153 and the back 145 of orifice member 126. A connector suitably secured into the opening 154 of link 130 thus oscillates automatically with link 130 between advanced and retracted positions and may operate the automatic belt tensioning mechanism described in the aforementioned patents. Studs 156 projecting from cover 116 mount actuator 110 in the desired position.

The position of fitting 120 within tubular portion 119 may be adjusted to select the distance between the advanced and retracted positions and thus establish the desired stroke of link 130.

Actuators 10 and 110 are operated by connecting fittings 20 and 120 to a source of vacuum, and a valve may be included in the connection between the fitting and the vacuum source to operate the actuator whenever desired.

The embodiments of the invention in which an exclusive property or privilege is claimed are defined as follows:

1. A self oscillating vacuum actuator comprising a housing, a diaphragm assembly secured to said housing to define a chamber, said housing having a fitting adapted for connection to a source of vacuum for applying vacuum to said chamber, said diaphragm assembly moving to a retracted position in response to application of vacuum to said chamber, said diaphragm assembly including a member having an orifice for admitting air to said chamber, a return spring for moving said diaphragm assembly to an advanced position in response to admission of air to said chamber, a valve assembly carried by said orifice member, a pilot spring seated against said orifice member and said valve assembly and biasing said valve assembly to engage said orifice member for obstructing admission of air through said orifice to said chamber, said valve assembly engaging said housing for obstructing application of vacuum through said fitting to said chamber as said diaphragm assembly moves to said retracted position, said valve assembly having a compressible portion responsive to vacuum in said fitting during engagement of said valve assembly with said housing for disengaging said valve assembly from said orifice member whereupon air is admitted through said orifice to said chamber and said return spring moves said diaphragm assembly to said extended position, said orifice member acting through said pilot spring to disengage said valve assembly from said housing and said pilot spring effecting engagement of said valve assembly with said orifice member to obstruct admission of air through said orifice as said diaphragm assembly moves to said advanced position whereupon vacuum is applied through said fitting to said chamber and said diaphragm assembly moves to said retracted position, and an actuating link carried by said diaphragm assembly whereby said link is oscillated between advanced and retracted positions when said fitting is connected to a source of vacuum.

* * * * *